US006773232B2

(12) United States Patent
Powers

(10) Patent No.: US 6,773,232 B2
(45) Date of Patent: Aug. 10, 2004

(54) PROGRESSIVE SHEAR ASSEMBLY FOR OUTBOARD MOTORS AND OUT DRIVES

(76) Inventor: Charles S. Powers, 575 Unadilla, Shreveport, LA (US) 71106

( * ) Notice: Subject to any disclaimer, the term of this patent is extended or adjusted under 35 U.S.C. 154(b) by 92 days.

(21) Appl. No.: 10/206,644

(22) Filed: Jul. 26, 2002

(65) Prior Publication Data

US 2003/0021691 A1 Jan. 30, 2003

Related U.S. Application Data

(60) Provisional application No. 60/308,460, filed on Jul. 30, 2001.

(51) Int. Cl.[7] ..... B63H 23/34
(52) U.S. Cl. ..... 416/134 R; 416/244 B
(58) Field of Search ..... 416/2, 93 A, 134 R, 416/244 B, 245 A, 247 A

(56) References Cited

U.S. PATENT DOCUMENTS

| | | | | |
|---|---|---|---|---|
| 2,539,630 A | | 1/1951 | Krueger et al. | 416/134 R |
| 2,751,987 A | * | 6/1956 | Kiekhaefer | 416/134 R |
| 2,869,774 A | | 1/1959 | Smith et al. | 416/185 |
| 2,993,544 A | | 7/1961 | Carlson | 416/134 R |
| 3,045,763 A | | 7/1962 | Perrott | 416/134 R |
| 3,064,454 A | | 11/1962 | Sharples | 464/33 |
| 3,096,106 A | | 7/1963 | Wanner | 416/134 R |
| 3,136,370 A | | 6/1964 | Carlson | 416/224 R |
| 3,256,939 A | | 6/1966 | Novak | 416/134 R |
| 3,307,634 A | | 3/1967 | Bihlmire | 416/134 R |
| 3,318,388 A | | 5/1967 | Bihlmire | 416/134 R |
| 3,407,882 A | | 10/1968 | Wooden | 416/244 R |
| 3,563,670 A | | 2/1971 | Knuth | 416/134 R |
| 3,701,611 A | | 10/1972 | Lambrecht | 416/134 R |
| 3,748,061 A | | 7/1973 | Henrich | 416/134 R |
| 4,338,064 A | | 7/1982 | Carmel | 416/134 R |
| 4,452,591 A | | 6/1984 | Fishbaugh et al. | 416/134 R |
| 4,566,855 A | | 1/1986 | Costabile et al. | 416/134 R |
| 4,575,310 A | | 3/1986 | Otani | 416/134 R |
| 4,826,404 A | | 5/1989 | Zwicky | 416/134 R |
| 4,842,483 A | | 6/1989 | Geary | 416/93 A |
| 5,049,034 A | * | 9/1991 | Cahoon | 416/134 R |
| 5,201,679 A | | 4/1993 | Velte, Jr. et al. | 416/134 R |
| 5,322,416 A | | 6/1994 | Karls et al. | 416/134 R |
| 5,484,264 A | | 1/1996 | Karls et al. | 416/134 R |
| 5,522,743 A | | 6/1996 | Patti | 416/134 R |
| 5,908,284 A | * | 6/1999 | Lin | 416/134 R |
| 6,478,543 B1 | * | 11/2002 | Tuchscherer et al. | 416/134 R |

OTHER PUBLICATIONS

Merriam–Webster Collegiate Dictionary, Tenth Edition, 1996, pp. 370 and 904.*

* cited by examiner

*Primary Examiner*—Edward K. Look
*Assistant Examiner*—Richard A. Edgar
(74) *Attorney, Agent, or Firm*—John M. Harrison

(57) ABSTRACT

A progressive shear assembly which is suitably adapted for connecting a marine propeller to a propeller drive shaft in such a manner that a selected resilience and torsional resistance of the propeller with respect to the drive shaft is achieved. An adaptor shaft provided on the propeller drive shaft drivingly engages the propeller through multiple sets of shear rods each having a selected composition and resilience. In the event that the rotating propeller inadvertently strikes an underwater object, the shear rods absorb the torque shock. Accordingly, the shear rods tend to deform and shear to prevent damage to the propeller and propeller drive train components, and can be easily and inexpensively replaced.

20 Claims, 3 Drawing Sheets

PROGRESSIVE SHEAR ASSEMBLY FOR OUTBOARD MOTORS AND OUT DRIVES

CROSS-REFERENCE TO RELATED APPLICATIONS

This application claims the benefit of copending U.S. Provisional Application Serial No. 60/308,460, filed Jul. 30, 2001.

FIELD OF THE INVENTION

This invention relates to resilient propeller hub assemblies capable of transmitting torque from a propeller drive shaft to a marine propeller and absorbing torque shock in the event that the propeller inadvertently strikes underwater objects. More particularly, the invention relates to a progressive shear assembly typically including multiple shear rods of the same or various hardness and resilience and which can be interposed between a propeller drive shaft and a marine propeller in selected combinations, ratios and sequences and in such a manner that a selected resilience and torsional resistance of the propeller with respect to the drive shaft is achieved for different applications of the propeller. Typically, a rod seat is defined between adjacent ones of multiple torsion ribs provided in spaced-apart relationship to each other in the propeller hub. An adaptor shaft, provided with one or more drive ribs that interface with the respective torsion ribs in the propeller hub, engages the drive shaft for rotation therewith. Multiple shear rods are provided in each of the rod seats, and the shear rods in each rod seat can be of the same or different materials of construction and resilience to achieve a selected balance of torque resistance and resilience of the propeller with respect to the drive shaft in the event that the propeller strikes a submerged object. In that event, as rotation of the propeller suddenly stops or slows and the drive shaft continues to rotate, the shear rods are compressed between a corresponding one of the drive ribs on the adaptor shaft and the corresponding torsion rib in the propeller hub, and the resultant torque shock is absorbed by the shear rods. Accordingly, the shear rods tend to deform and shear and prevent or minimize damage to the propeller and propeller drive train components, and can be easily and inexpensively replaced. Some of the shear rods typically remain intact to facilitate continued structural integrity and drive capability between the drive shaft and the propeller and continued operation of the propeller. In another embodiment, a torsion sleeve is provided in the propeller hub and a drive sleeve, mounted on the propeller drive shaft, extends into the torsion sleeve. Multiple shear rods are interposed between a pair of torsion ribs provided on the torsion sleeve and a pair of drive ribs that extend from the drive sleeve and interface with the torsion ribs.

While past techniques for securing propellers to propeller drive shafts include welding, pinning or splining, excessive torque loading or shock applied to the drive shaft, gears and other propeller drive train components has a tendency to damage the components in the event that the rotating propeller strikes a submerged obstacle. Consequently, repairing the propeller, drive shaft, gears or other propeller drive train components can be expensive and time-consuming. Various patents of interest in this regard include U.S. Pat. Nos. 2,363,469; 2,539,630; 2,869,774; 2,993,544; 3,045,763; 3,096,106; 3,136,370; 3,256,939; 3,307,634; 3,318,388; 3,407,882; 3,563,670; 3,701,611; 3,748,061; 4,338,064; 4,452,591; 4,566,855; 4,575,310; 4,826,404; 4,842,483; 5,049,034; 5,201,679; 5,322,416; 5,484,264; and 5,522,743.

An object of this invention is to provide a progressive shear assembly which is capable of preventing damage to a marine propeller or various components of the propeller drive train during operating load periods and in the event that the propeller strikes an underwater obstacle.

Another object of this invention is to provide a progressive shear assembly suitably adapted for propellers, including multiple rods of selected shape and uniform or various hardness and resiliency which absorb torque shock in the event that a marine propeller strikes a submerged object to prevent damage to the propeller and/or drive shaft, gears or other propeller drive train components.

Still another object of the invention is to provide a progressive shear assembly for propellers, including multiple shear rods or cylinders of selected composition, resiliency, configuration and length and which can be arranged in selected combinations and sequences with respect to each other to impart a selected longitudinal cushioning effect as well as torque resistance and torsional resilience between a marine propeller and a drive shaft for the propeller.

Yet another object of this invention is to provide a progressive shear assembly for marine propellers, including multiple shear rods or cylinders of selected cross-sectional configuration, length, hardness and resiliency and at least some of which shear rods or cylinders are air or gas-filled, for absorbing torque shock during operating loads and in the event that the propeller inadvertently strikes a submerged obstacle, which shear rods or cylinders can be easily and inexpensively replaced.

A still further object of this invention is to provide a progressive shear assembly capable of connecting a marine propeller to a propeller drive shaft attached to a boat motor, which progressive shear assembly includes multiple shear rods or cylinders of selected composition, resilience, length and configuration, some of which shear rods are sheared to absorb torque shock during power surges and in the event that the rotating propeller strikes an underwater obstacle and others of which shear rods or cylinders may remain intact to provide continued drive capability between the drive shaft and the propeller and facilitate continued operation of the propeller and structural integrity of the drive shaft and drive train.

Another object of this invention is to provide a progressive shear assembly including a torsion sleeve provided in a propeller hub; a drive sleeve mounted on the propeller drive shaft and extending into the torsion sleeve; multiple shear rods or cylinders interposed between a pair of torsion ribs provided on the torsion sleeve; and a pair of drive ribs that extend from the drive sleeve and interface with the torsion ribs.

SUMMARY OF THE INVENTION

These and other objects of the invention are provided in a progressive shear assembly typically including multiple solid or gas-filled shear rods or cylinders of similar or various resilience, composition and length and which can be interposed between a propeller hub of a marine propeller and a propeller drive shaft in selected lengths, cross-sectional configurations, combinations, ratios and sequences in such a manner that a desired balance of resilience and torsional, as well as longitudinal resistance of the propeller hub with respect to the drive shaft is achieved for different applications of the propeller. Typically, a rod seat is defined between adjacent ones of multiple torsion ribs provided in spaced-apart relationship to each other in the propeller hub. An adaptor shaft, provided with multiple drive ribs that interface with the respective torsion ribs in the propeller hub, engages the propeller drive shaft for rotation therewith. Multiple shear rods or cylinders are provided in each of the rod seats, and the shear rods or cylinders in each rod seat can all be the same composition and resilience or any combination and sequence of shear rods or cylinders having different compositions and resilience to achieve a selected balance of torsional and/or longitudinal resistance and resilience of the propeller with respect to the drive shaft during power surges and in the event that the propeller strikes a submerged object and suddenly slows or stops rotation. In that event, the shear rods or cylinders are compressed and one or more of the rods or cylinders sheared between a corresponding one of the drive ribs on the adaptor shaft and the corresponding torsion rib in the propeller hub as the torque shock imparted by the still-rotating drive shaft is absorbed by the shear rods or cylinders. Accordingly, the shear rods or cylinders tend to deform and shear and prevent damage to the propeller or the drive shaft, gears or other propeller drive train components, and can be easily and inexpensively replaced. Some of the shear rods or cylinders typically remain intact to facilitate continued structural integrity and drive capability between the motor drive shaft and the propeller and continued operation of the propeller. In another embodiment, a torsion sleeve is provided in the propeller hub and a drive sleeve, mounted on the propeller drive shaft, extends into the torsion sleeve. Multiple shear rods or cylinders are interposed between a pair of torsion ribs provided on the torsion sleeve and a pair of drive ribs that extend from the drive sleeve and interface with the torsion ribs.

BRIEF DESCRIPTION OF THE DRAWINGS

The invention will be better understood by reference to the accompanying drawings, wherein.

DESCRIPTION OF THE PREFERRED EMBODIMENTS

Figures 1, 2, 3:
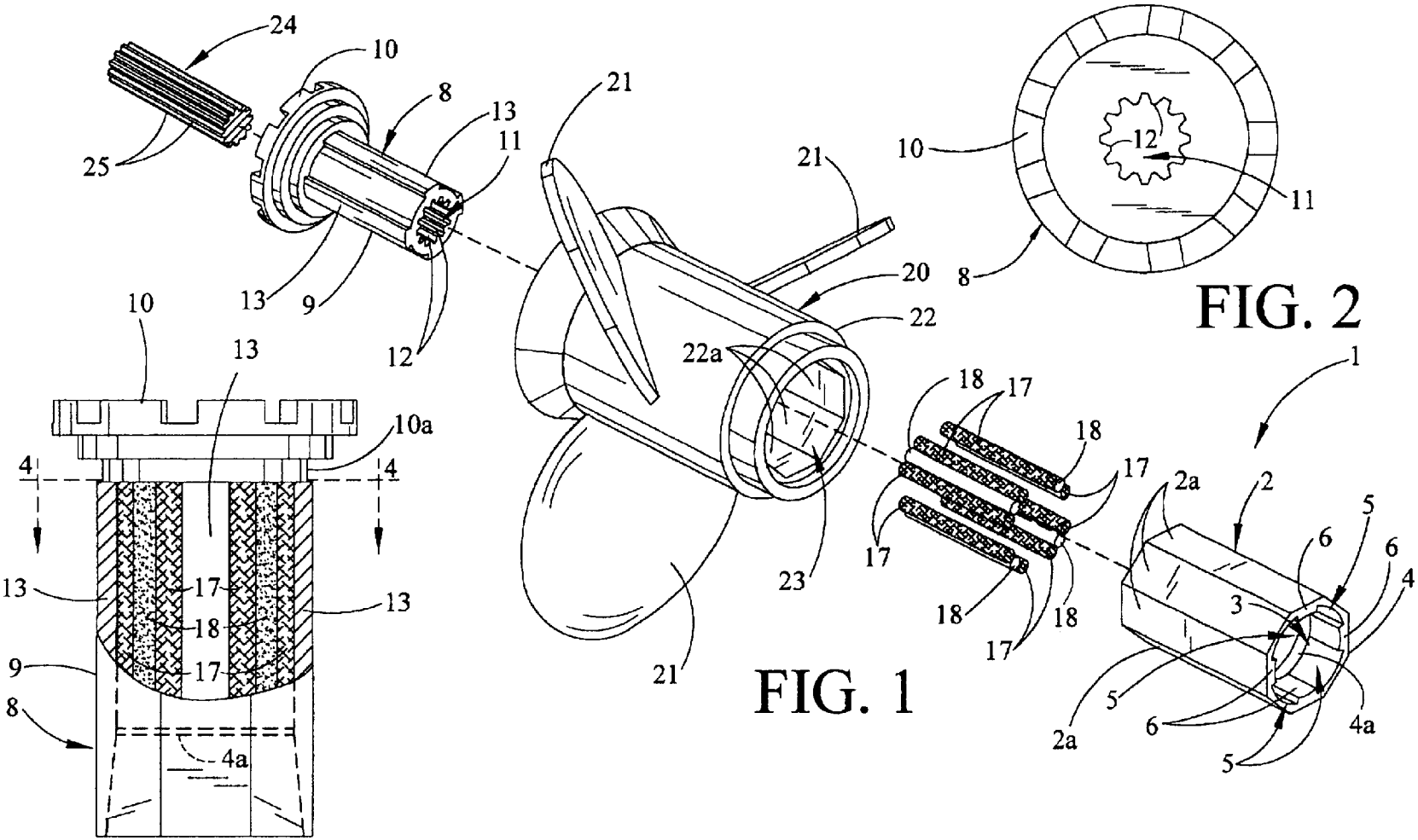
FIG. 1 is an exploded, perspective view of an illustrative embodiment of the progressive shear assembly of this invention.
FIG. 2 is a front view of a drive adaptor component of the progressive shear assembly.
FIG. 3 is a side view, partially in section, of the drive adaptor illustrated in FIG. 2, with multiple shear rods or cylinders seated between adjacent drive ribs of the drive adaptor.
Figure 4:
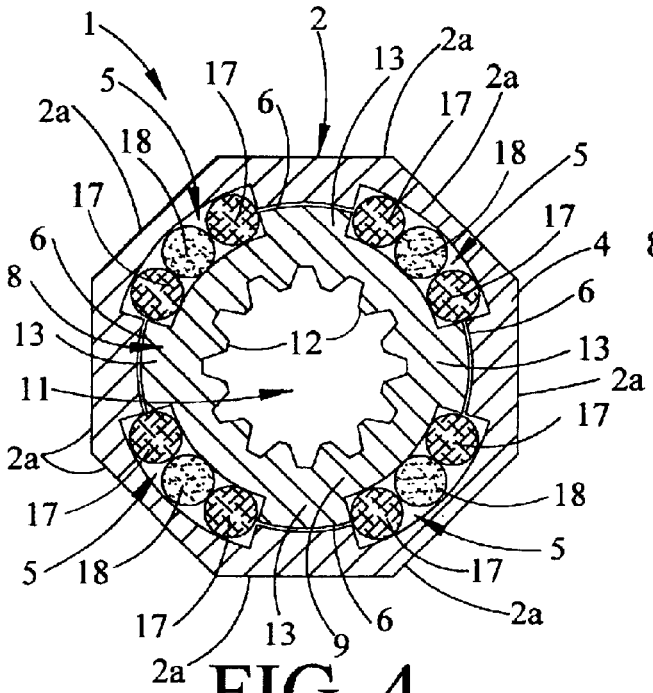
FIG. 4 is a sectional view, taken along section lines 4—4 in FIG. 3, of the drive adaptor, seated in a hub sleeve component of the progressive shear assembly with the shear rods or cylinders in place.
Figure 6:
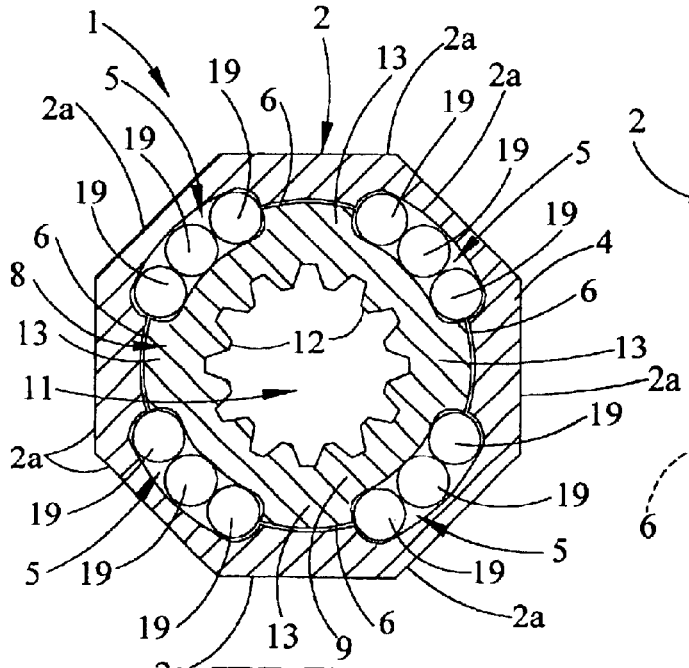
FIG. 6 is a sectional view, taken along section lines 4—4 in FIG. 3, of another embodiment of the progressive shear assembly.
Figure 5:
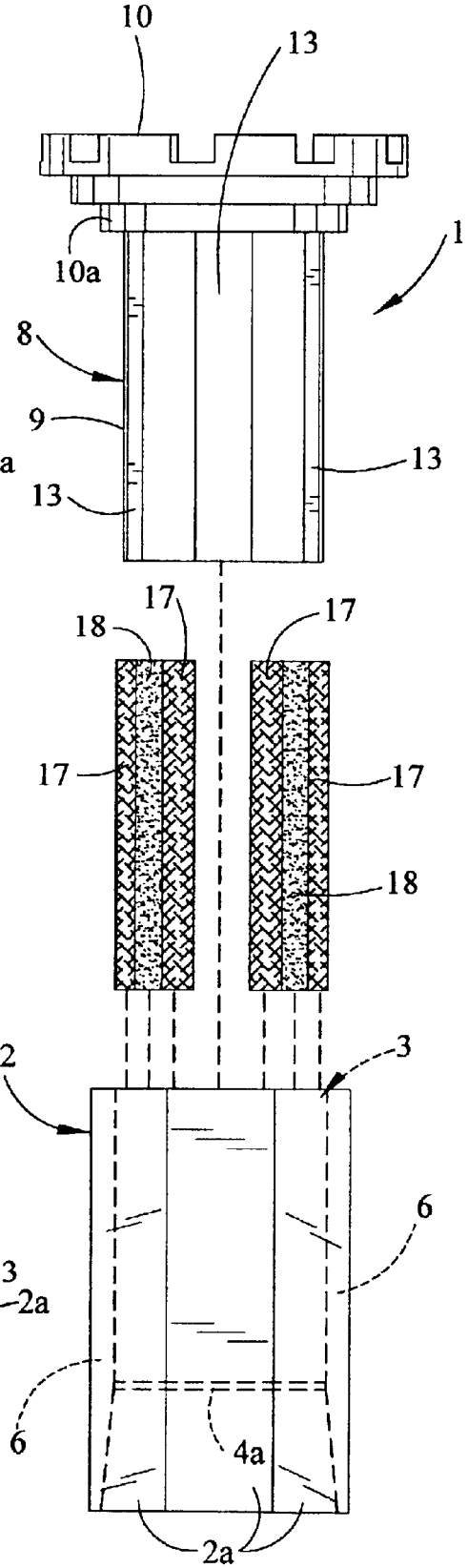
FIG. 5 is an exploded view of the progressive shear assembly.
Figure 7:
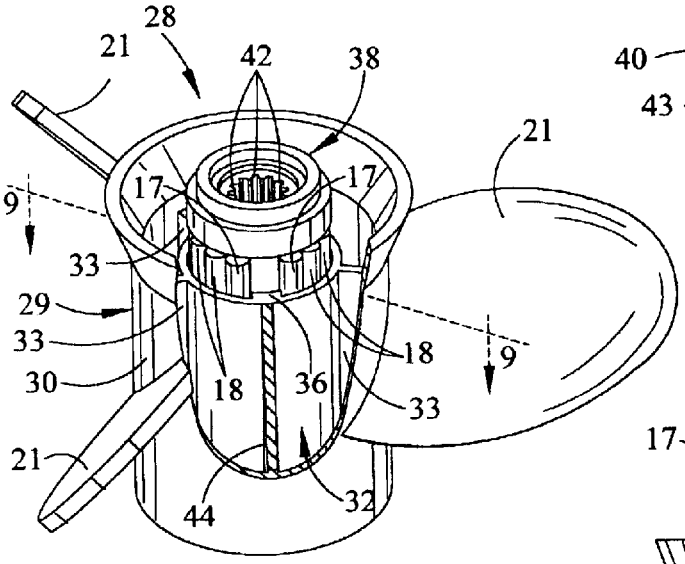
FIG. 7 is a perspective view, partially in section, of a propeller hub, more particularly illustrating another illustrative embodiment of the progressive shear assembly of this invention.
Figure 8:
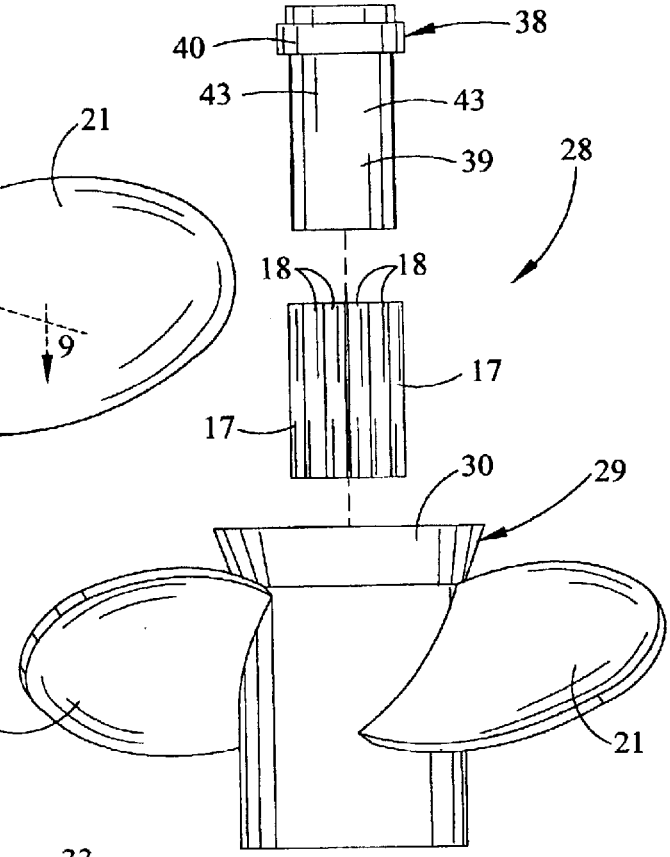
FIG. 8 is an exploded view of the progressive shear assembly illustrated in FIG. 7.

Referring initially to FIGS. 1–6 of the drawings, an illustrative embodiment of the progressive shear assembly of this invention is generally illustrated by reference numeral 1. As illustrated in FIG. 1, the progressive shear assembly 1 is suitably adapted for coupling a propeller drive shaft 24, provided with drive shaft splines 25 and connected to an outboard boat motor (not illustrated), and a marine propeller 20, having propeller blades 21 extending from a propeller hub 22. As hereinafter described, the progressive shear assembly 1 is designed to provide a selected torsional and longitudinal resistance between the propeller drive shaft 24 and the propeller hub 22 while imparting a selected resilience and progressive deformation and shear capability between those components to prevent or minimize damage to the propeller drive system during power surges and loads and in the event that one of the propeller blades 21 of the rotating propeller inadvertently strikes a submerged object (not illustrated). The progressive shear assembly 1 typically includes an elongated hub sleeve 2 which may be octagonal in cross-section, as illustrated in FIG. 4, or any other desired shape having multiple flat sleeve faces 2*a* which engage respective complementary hub faces 22*a* in the hub interior 23 of the propeller hub 22, as illustrated in FIG. 1, when the hub sleeve 2 is bolted or otherwise secured in the hub interior 23 according to the knowledge of those skilled in the art. As illustrated in FIGS. 1 and 5, the sleeve interior 3 of the hub sleeve 2 is typically circumscribed by a sleeve shoulder 4*a*. As illustrated in FIGS. 4–6, the inside surface of the sleeve wall 4 of the hub sleeve 2 includes multiple, typically arcuate rod seats 5 which are separated by parallel torsion ribs 6 extending from the sleeve wall 4 and into the sleeve interior 3 (FIG. 5) along the hub sleeve 2. Multiple plastic shear rods or cylinders 17, rubber shear rods 18, metal shear rods or cylinders 19 (FIG. 6), or selected combinations of the rubber shear rods 18, the plastic shear rods or cylinders 17 and the metal shear rods or cylinders 19 of selected composition, empty or gas-filled cavity, resilience and strength are seated in each rod seat 5 in selected combinations and sequences, between each pair of adjacent torsion ribs 6 and against the interior sleeve partition 4*a* (FIG. 3), for purposes which will be hereinafter described. A drive adaptor 8 of the progressive shear assembly 1 includes a circular adaptor base 10, fitted with a circular compression disc 10*a* (FIG. 5) and from which extends an elongated adaptor shaft 9 fitted with multiple longitudinal, external, adjacent drive ribs 13, and traversed by an adaptor bore 11, through which multiple adaptor drive splines 12 extend.

Referring again to FIGS. 4 and 6 and initially to FIG. 1 of the drawings, in assembly of the progressive shear assembly 1, the adaptor bore of the drive adaptor 8 receives the propeller drive shaft 24, with the drive shaft splines 25 thereof engaging the adaptor drive splines 12 of the drive adaptor 8. The adaptor shaft 9 of the drive adaptor 8 is seated in the sleeve interior 3 of the hub sleeve 2, with three of the plastic shear rods or cylinders 17, the rubber shear rods 18 or the metal shear rods or cylinders 19, or any combination of those, interposed between the adaptor shaft 9 and the sleeve wall 4 in each of the rod seats 5, as illustrated in FIG. 4. The drive ribs 13 of the drive adaptor 8 interface with the respective torsion ribs 6 of the hub sleeve 2 when the adaptor shaft 9 is seated in the hub sleeve interior 3. Accordingly, the plastic shear rods or cylinders 17, the rubber shear rods 18 and/or the metal shear rods or cylinders 19 are interposed between the outside arcuate surface of the adaptor shaft 9 and the arcuate inside surface of the sleeve wall 4 of the hub sleeve 2, as well as between the adjacent drive ribs 13 of the drive adaptor 8 and the interfacing adjacent torsion ribs 6 of the hub sleeve 2, in the respective rod seats 5. Additionally, the length of the plastic shear rods or cylinders 17 and/or rubber shear rods 18 can be chosen such that the plastic shear rods or cylinders 17 and/or rubber shear rods 18 are compressed between the sleeve shoulder 4*a* of the hub sleeve 2 and the compression disc 10*a* of the adaptor base 10, thus providing a tighter or more rigid fit of the plastic shear rods or cylinders 17 and/or rubber shear rods 18 in the respective rod seats 5. This expedient provides additional torsional resistance of the propeller drive shaft 24 with respect to the propeller 20.

In the embodiment illustrated in FIG. 4, a rubber shear rod 18 is interposed between a pair of plastic shear rods or cylinders 17 in each rod seat 5 to achieve a torsional resistance and resilience which is a function of the combined resilience of the plastic shear rods or cylinders 17 and the rubber shear rods 18. It is understood that three of the plastic shear rods or cylinders 17, three of the rubber shear rods 18 or three of the metal shear rods or cylinders 19, or any combination of the plastic shear rods or cylinders 17, rubber shear rods 18 and metal shear rods or cylinders 19 can be seated in each rod seat 5 instead, depending upon the desired resilience and torsional resistance characteristics of the propeller 20 with respect to the propeller drive shaft 24. For example, in applications where a constant or variable, considerably high torque load is applied to the progressive shear assembly 1 as occurs, for example, in start-up loads in high-speed boat racing, three plastic shear rods or cylinders 17 may typically be provided in each rod seat 5. For lower torque load applications, the plastic shear rods or cylinders 17 can be used in combination and in selected sequences with the rubber shear rods 18, with the rubber shear rod 18 interposed between a flanking pair of plastic shear rods or cylinders 17, as illustrated, or the plastic shear rods or cylinders 17 adjacent to each other with the rubber shear rod 18 adjacent to one of the plastic shear rods or cylinders 17. Under circumstances in which the progressive shear assembly 1 undergoes minimal torque loading during application, a typical set of three rubber shear rods 18 or a pair of rubber shear rods 18 in combination with a plastic shear rod or cylinder 17 in any selected sequence can be seated in each rod seat 5. Finally, when little or no shearing is desired in the event that one or more of the propeller blades 21 strikes an underwater object, the metal shear rods or cylinders 19, typically constructed of brass or aluminum, may be seated in each rod seat 5, as illustrated in FIG. 6.

Referring again to FIGS. 1 and 4 of the drawings, in typical operation of the progressive shear assembly 1, as the rotating propeller drive shaft 24 applies a torque load to the drive adaptor 8, the adaptor shaft 9 of the drive adaptor 8 rotates in the clockwise direction in FIG. 4, and each drive rib 13 of the adaptor shaft 9 applies pressure against the adjacent plastic shear rod or cylinder 17, which applies pressure against the intervening rubber shear rod 18, and the rubber shear rod 18, in turn, applies pressure against the plastic shear rod or cylinder 17 which engages the adjacent torsion rib 6 of the hub sleeve 2. Consequently, the plastic shear rods or cylinders 17 and intervening rubber shear rod 18 are progressively compressed between each drive rib 13 of the adaptor shaft 9 and the adjacent torsion rib 6 of the hub sleeve 2, and the plastic shear rods or cylinders 17 and rubber shear rods 18 collectively transmit torsion from the drive ribs 13 to the torsion ribs 6 to rotate the propeller 20. In the event of sudden gear changes or power surges at start-up, or if one or more of the propeller blades 21 strikes an underwater obstacle (not illustrated), rotation of the propeller hub 22 suddenly slows or stops as the adaptor shaft 9 of the drive adaptor 8 continues to be rotated by the propeller drive shaft 24. Consequently, rotation of the torsion ribs 6 with the hub sleeve 2 substantially slows down or stops as the drive ribs 13 of the adaptor shaft 9 continue clockwise rotation with the drive adaptor 8, and the plastic shear rods or cylinders 17 and rubber shear rods 18 are progressively sheared as the compressive torque load generated between the slow or stationary torsion ribs 6 and the rotating drive ribs 13 increases. Accordingly, the plastic shear rod or cylinder 17 adjacent to the corresponding impinging drive rib 13 typically shears first, followed by the sandwiched rubber shear rod 18 and finally, the plastic shear rod or cylinder 17 adjacent to the corresponding torsion rib 6 of the hub sleeve 2, any or all of which rubber shear rods 18 and plastic shear rods or cylinders 17 may or may not shear, depending upon the magnitude of the torque load or shock between the hub sleeve 2 and the motor drive shaft 24 and whether the propeller 20 disengages the submerged obstacle. Typically, the rubber shear rod 18 and the remaining plastic shear rod or cylinder 17 or at least, the remaining plastic shear rod or cylinder 17 in each set remains unsheared, to provide continued driving engagement of the propeller drive shaft 24 with the propeller 20 and facilitate sustained rotation and driving operation of the submerged propeller 20 in the water. The sheared or damaged plastic shear rods or cylinders 17 and rubber shear rods 18 can be easily replaced by removing the adaptor shaft 9 of the drive adaptor 8 from the hub interior 23; removing the sheared or damaged plastic shear rods or cylinders 17 and rubber shear rods 18 from the rod seats 5; positioning replacement plastic shear rods or cylinders 17 and rubber shear rods 18 in the rod seats 5; and re-inserting the adaptor shaft 9 of the drive adaptor 8 in the hub interior 3.

It will be appreciated by those skilled in the art that the progressive shear assembly 1 can be constructed using plastic shear rods or cylinders 17, rubber shear rods 18, metal shear rods or cylinders 19 or wooden shear rods or cylinders (not illustrated) of any selected resilience, porosity or hardness, cross-sectional configuration and length, to achieve a selected resilience and torsional, as well as longitudinal resistance between the propeller drive shaft 24 and the propeller 20. It is understood that the shear rods or cylinders can be constructed in any desired cross-sectional shape, including polygonal, and the resilience and torsional resistance can further be modified, as desired, by varying the length and wall-thickness of tubular shear rods, with greater lengths increasing the torsional and longitudinal resistance and decreasing the resilience, and smaller lengths decreasing the torsional and longitudinal resistance and increasing the resilience. Referring again to FIG. 4, it will be further appreciated by those skilled in the art that any desired number of the rod seats 5 can be provided in the sleeve wall 4 of the hub sleeve 2, and further, any desired number of the shear rods or cylinders of selected resilience and composition can be positioned in each rod seat 5 to achieve the desired torsional resistance and resilience. While the rubber shear rods 18 can be any selected hardness, typical hardness for the rubber shear rods 18 is in the range 80–90 duro rubber. The rubber shear rods 18 may also be hollow and filled with a compressed gas such as air to vary the resistance to shear.

It will be appreciated by those skilled in the art that the resilience and torsional resistance between the propeller 20 and the propeller drive shaft 24 can can be varied by maintaining a squared-off configuration on the respective longitudinal edges of each torsion rib 6, as illustrated in FIG. 5, in which case each torsion rib 6 applies a point load to the outer shear rods or cylinders in each rod seat 5, or by rounding off and matching the lateral edges of each torsion rib 6 with the curvature of the outer shear rods or cylinders in each rod seat 5, as illustrated in FIG. 6. The torsional resistance can be further modified by varying the extent of overlap of the drive ribs 13 of the drive adaptor 8 with respect to the diameter of the shear rods or cylinders. For example, the drive ribs 13 illustrated in FIGS. 4 and 6 extend about halfway along the diameter, or coextensive with the radius, of the plastic shear rods or cylinders 17, the rubber shear rods 18 and the metal shear rods or cylinders 19, respectively. By extending the length of the drive ribs 13 radially outwardly from the adaptor shaft 9 to overlap the shear rods or cylinders at a point greater than the radius of each, a greater portion of the shear rods or cylinders is compressed directly between the drive ribs 13 of the drive adaptor 8 and the torsion ribs 6 of the hub sleeve 2. Consequently, the torsional resistance will increase and the resiliency will decrease between the propeller 20 and the propeller drive shaft 24.

Referring again to FIG. 1 of the drawings, it is understood that in an alternative embodiment of the invention the hub sleeve 2 can be omitted, in which case the rod seats 5 and alternating torsion ribs 6 can be provided in the interior surface of the propeller hub 22, rather than in the sleeve wall 4 of the hub sleeve 2; the plastic shear rods or cylinders 17, the rubber shear rods 18, the metal shear rods or cylinders 19 and/or the wooden shear rods or cylinders (not illustrated) provided in the rod seats 5 typically in sets of three; and the adaptor shaft 9 of the drive adaptor 8 inserted in the hub interior 23, in the same manner as heretofore described with respect to the sleeve interior 3 of the hub sleeve 2.

Figure 9:
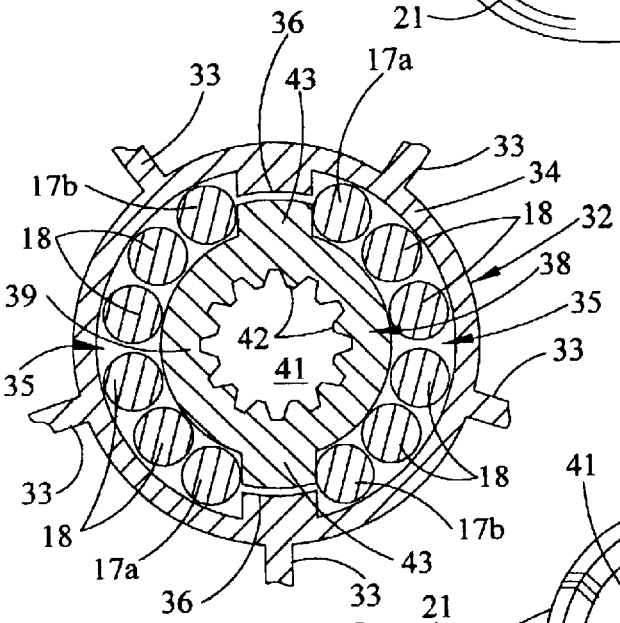
FIG. 9 is a sectional view, taken along section lines 9—9 in FIG. 7, of the progressive shear assembly.
Figure 10:
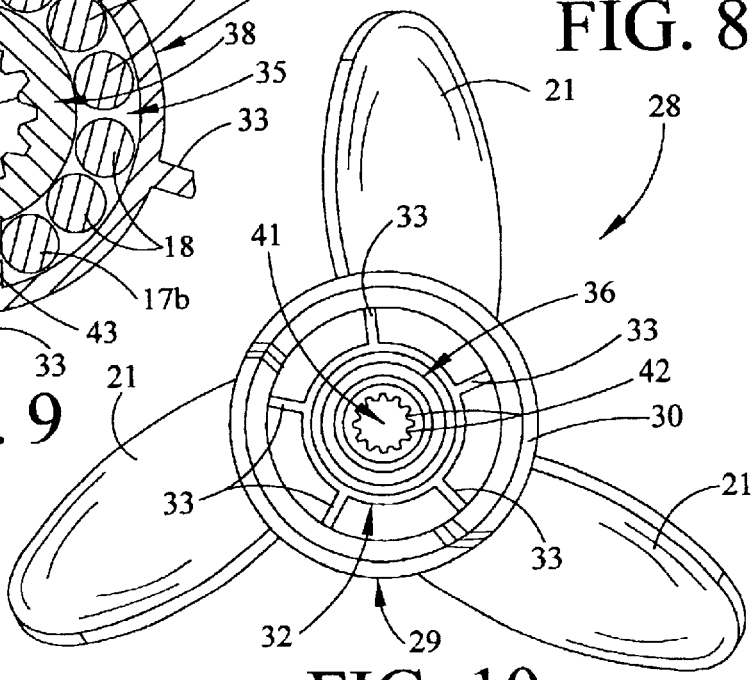
FIG. 10 is a rear view of the propeller and progressive shear assembly illustrated in FIGS. 7–9.

Referring next to FIGS. 7–10 of the drawings, in another embodiment the progressive shear assembly, generally illustrated by reference numeral 28, includes a hub sleeve 32, having a cylindrical sleeve wall 34 and mounted concentrically in a propeller hub 30 of a marine propeller 29 typically by means of multiple, radially-extending hub sleeve mount vanes 33. As illustrated in FIG. 9, a pair of torsion ribs 36 extends from the hub sleeve 32 into the hub sleeve 32 interior, typically in diametrically-opposed relationship to each other. A drive adaptor 38, having an elongated adaptor shaft 39 which extends from an adaptor base 40 and is provided with a pair of longitudinally-extending, typically diametrically-opposed drive ribs 43, is disposed inside the hub sleeve 32. The drive adaptor 38 is mounted on the propeller drive shaft 24 (FIG. 1) and includes interior adaptor drive splines 42 that extend into an adaptor bore 41 and drivingly engage the multiple drive shaft splines 25 (FIG. 1) of the propeller drive shaft 24. As further illustrated in FIG. 9, the diametrically-opposed drive ribs 43 of the adaptor shaft 39 interface with the respective torsion ribs 36 of the hub sleeve 32, and define a pair of semicircular rod seats 35 on opposite sides of the drive adaptor 38. Multiple plastic shear rods or cylinders 17, rubber shear rods 18 and/or metal shear rods or cylinders 19 (FIG. 6) are interposed between the torsion ribs 36 of the hub sleeve 32 and the interfacing drive ribs 43 of the drive adaptor 38, in each of the rod seats 35. In FIG. 9, six shear rods or cylinders are shown seated in each of the two rod seats 35, with typically four rubber shear rods 18 interposed between a pair of terminal plastic shear rods or cylinders 17*a* and 17*b*, respectively, each of which plastic shear rods or cylinders 17*a* and 17*b* abuts against the corresponding interfacing torsion rib 36 and drive rib 43 pair. Alternatively, it is understood that various combinations of the plastic shear rods or cylinders 17, the rubber shear rods 18 and/or the metal shear rods or cylinders 19 can be used depending upon the desired balance of resilience and torsional resistance of the propeller 29 with respect to the propeller drive shaft 24. In use, as the propeller drive shaft 24 rotates the drive adaptor 38 in the clockwise direction illustrated in FIG. 9, each of the drive ribs 43 of the drive adaptor 38 exerts rotational pressure against the corresponding adjacent plastic shear rod or cylinder 17*a*, and the rubber shear rods 18 are compressed between the plastic shear rods or cylinders 17*a* and 17*b* as the terminal plastic shear rod or cylinder 17*b* exerts pressure against the corresponding adjacent torsion rib 36 of the hub sleeve 32 to rotate the hub sleeve 32. The hub sleeve 32 transmits rotation to the propeller hub 30 and propeller blades 21 of the propeller 29, through the multiple hub sleeve mount vanes 33. In the event that one or more of the blades 21 strikes an underwater obstacle (not illustrated) and rotation of the propeller 29 suddenly slows or stops relative to rotation of the propeller drive shaft 24, the propeller drive shaft 24 continues to rotate and one or more of the plastic shear rods or cylinders 17, rubber shear rods 18 and/or metal shear rods or cylinders 19 deforms and shears to absorb the torque shock imparted by the still-rotating drive shaft 24 on the propeller hub 30 and connected hub sleeve 32.

While the preferred embodiments of the invention have been described above, it will be recognized and understood that various modifications can be made in the invention and the appended claims are intended to cover all such modifications which may fall within the spirit and scope of the invention.

Having described my invention with the particularity set forth above, what is claimed is:

1. A progressive shear assembly for connecting a drive shaft to a propeller having a propeller hub and a hub interior, said progressive shear assembly comprising:

a plurality of torsion ribs for mounting in the hub interior in radially-extending relationship with respect to the propeller hub and a plurality of rod seats defined between said plurality of torsion ribs, respectively;

wherein the propeller hub is rotatable with said plurality of torsion ribs;

an adaptor shaft for engaging the drive shaft;

a plurality of drive ribs provided on said adaptor shaft and interfacing with said plurality of torsion ribs, respectively; and at least two shear rods disposed in each of said plurality of rod seats, said at least two shear rods constructed of a selected material and disposed in adjacent and contacting relationship with respect to each other, whereby said at least two shear rods are compressed between a corresponding one of said plurality of drive ribs and a corresponding one of said plurality of torsion ribs and against each other responsive to rotating the propeller on the drive shaft.

2. The progressive shear assembly of claim 1 wherein said plurality of torsion ribs comprises a pair of torsion ribs for mounting in the hub interior in spaced-apart relationship with respect to each other, said plurality of rod seats comprises a pair of rod seats defined between said pair of torsion ribs, and said plurality of drive ribs comprises a pair of drive ribs provided on said adaptor shaft in spaced-apart relationship with respect to each other.

3. The progressive shear assembly of claim 1 wherein said plurality of torsion ribs comprises four torsion ribs for mounting in the hub interior in spaced-apart relationship with respect to each other, said plurality of rod seats comprises four rod seats defined between said four torsion ribs, and said plurality of drive ribs comprises four drive ribs provided on said adaptor shaft in spaced-apart relationship with respect to each other.

4. The progressive shear assembly of claim 1 wherein said selected material is plastic or rubber.

5. The progressive shear assembly of claim 1 comprising a drive adaptor having an adaptor base and wherein said adaptor shaft extends from said adaptor base.

6. The progressive shear assembly of claim 5 wherein said selected material is plastic or rubber.

7. The progressive shear assembly of claim 5 wherein said selected material is plastic.

8. The progressive shear assembly of claim 5 wherein said selected material is rubber.

9. The progressive shear assembly of claim 1 comprising a hub sleeve for engaging the hub interior and wherein said plurality of torsion ribs is provided on said hub sleeve.

10. The progressive shear assembly of claim 2 comprising a hub sleeve for engaging the hub interior and wherein said pair of torsion ribs is provided on said hub sleeve.

11. The progressive shear assembly of claim 3 comprising a hub sleeve for engaging the hub interior and wherein said four torsion ribs is provided on said hub sleeve.

12. The progressive shear assembly of claim 4 comprising a hub sleeve for engaging the hub interior and wherein said plurality of torsion ribs is provided on said hub sleeve.

13. The progressive shear assembly of claim 5 comprising a hub sleeve for engaging the hub interior and wherein said plurality of torsion ribs is provided on said hub sleeve.

14. The progressive shear assembly of claim 6 comprising a hub sleeve for engaging the hub interior and wherein said plurality of torsion ribs is provided on said hub sleeve.

15. The progressive shear assembly of claim 7 comprising a hub sleeve for engaging the hub interior and wherein said plurality of torsion ribs is provided on said hub sleeve.

16. The progressive shear assembly of claim 8 comprising a hub sleeve for engaging the hub interior and wherein said plurality of torsion ribs is provided on said hub sleeve.

17. A progressive shear assembly for connecting a motor drive shaft to a propeller having a propeller hub and a hub interior, said progressive shear assembly comprising:

a plurality of torsion ribs for mounting in the hub interior in radially-extending relationship with respect to the propeller hub and a plurality of rod seats defined between said plurality of torsion ribs, respectively;

wherein the propeller hub is rotatable with said plurality of torsion ribs;

an adaptor shaft for engaging the motor drive shaft and extending through the hub interior adjacent to said plurality of rod seats;

a plurality of drive ribs provided on said adaptor shaft for interfacing with said plurality of torsion ribs, respectively;

at least two shear rods constructed of a selected material and disposed in each of said plurality of rod seats, said at least two shear rods disposed in adjacent and contacting relationship with respect to each other, whereby said at least two shear rods are compressed between a corresponding one of said plurality of drive ribs and a corresponding one of said plurality of torsion ribs and against each other responsive to rotating the propeller on the motor drive shaft; and wherein said selected material is rubber, plastic, metal or wood.

18. The progressive shear assembly of claim 17 wherein said plurality of torsion ribs comprises a pair of torsion ribs for mounting in the hub interior in spaced-apart relationship with respect to each other, said plurality of rod seats comprises a pair of rod seats defined between said pair of torsion ribs, and said plurality of drive ribs comprises a pair of drive ribs provided on said adaptor shaft in spaced-apart relationship with respect to each other.

19. The progressive shear assembly of claim 17 wherein said plurality of torsion ribs comprises four torsion ribs for mounting in the hub interior in spaced-apart relationship with respect to each other, said plurality of rod seats comprises four rod seats defined between said four torsion ribs, and said plurality of drive ribs comprises four drive ribs provided on said adaptor shaft in spaced-apart relationship with respect to each other.

20. A progressive shear assembly for connecting a motor drive shaft to a propeller having a propeller hub and a hub interior, said progressive shear assembly comprising:

a plurality of torsion ribs for mounting in the hub interior in radially-extending relationship with respect to the propeller hub and a plurality of rod seats defined between said plurality of torsion ribs, respectively;

wherein the propeller hub is rotatable with said plurality of torsion ribs;

an adaptor shaft for engaging the motor drive shaft and extending through the hub interior adjacent to said plurality of rod seats;

a plurality of drive ribs provided on said adaptor shaft for interfacing with said plurality of torsion ribs, respectively;

at least three shear rods disposed in each of said plurality of rod seats, said at least three shear rods disposed in adjacent and contacting relationship with respect to each other, whereby said at least three shear rods are compressed between a corresponding one of said plurality of drive ribs and a corresponding one of said plurality of torsion ribs and against each other responsive to rotating the propeller on the motor drive shaft; and wherein said at least three shear rods comprises any combination of plastic shear rods, rubber shear rods and metal shear rods arranged in any sequence.

* * * * *